United States Patent [19]

Romberger et al.

[11] Patent Number: 4,529,572

[45] Date of Patent: Jul. 16, 1985

[54] POLYMER-ZINC CORROSION INHIBITOR

[75] Inventors: John A. Romberger, Oak Park; Laura J. Blaser, La Grange Park, both of Ill.

[73] Assignee: Nalco Chemical Company, Oak Brook, Ill.

[21] Appl. No.: 653,973

[22] Filed: Sep. 21, 1984

[51] Int. Cl.[3] ..... C23F 11/12; C09K 3/00

[52] U.S. Cl. ..... 422/17; 252/396; 252/389 R; 210/701; 422/19

[58] Field of Search ..... 252/389.52, 396; 210/701; 422/17, 19

[56] References Cited

U.S. PATENT DOCUMENTS

| | | | |
|---|---|---|---|
| 3,885,914 | 5/1975 | Hollingshad et al. | 252/401 X |
| 3,963,636 | 6/1976 | Harris et al. | 252/396 X |
| 4,008,164 | 2/1977 | Watson et al. | 252/180 X |
| 4,126,549 | 11/1978 | Jones et al. | 252/396 X |
| 4,196,272 | 4/1980 | Goretta et al. | 252/396 X |

FOREIGN PATENT DOCUMENTS

| | | | |
|---|---|---|---|
| 247 | 1/1970 | Japan | 422/7 X |

*Primary Examiner*—Edward A. Miller
*Assistant Examiner*—Matthew A. Thexton
*Attorney, Agent, or Firm*—John G. Premo; Robert A. Miller; Donald G. Epple

[57] ABSTRACT

Water soluble zinc copolymer complexes of acrylic acidethylacrylate copolymers are useful in preventing corrosion in aqueous recirculating systems.

4 Claims, No Drawings

POLYMER-ZINC CORROSION INHIBITOR

INTRODUCTION

In many industrial applications, it is necessary to use aqueous solutions or water for a variety of purposes such as heat transfer systems in which the water is used in heat exchangers, cooling towers, chillers, etc. The water will come in contact with metal surfaces of the system and, when being used in a recirculating system after being exposed to or saturated with air, will have a tendency to corrode the metal surfaces with which it comes in contact. In addition, when utilizing water in a recirculating system, the metal salts which are inherently present in certain types of water such as calcium, magnesium, etc. will tend to deposit out on the surface of the metal to cause a scale. The presence of this scale on the surface of the metal will inhibit the heat transfer capability of the metal and thus reduce the efficiency of the system.

It is important that the deposition of scale and the corrosion of the metal surfaces of the heat transfer equipment be minimized. The minimization of these problems can be accomplished by the addition of corrosion inhibitors to the water. In many instances different types of metals are used in the apparatus including iron in the form of steel, aluminum, copper, etc. Copper is known as an accelerator for the corrosion of iron and therefore any corrosion inhibitor must include a copper chelating component in order to again minimize the corrosion of the metal.

THE INVENTION

The invention is a composition for preventing corrosion and scale in aqueous recirculating systems which comprises an aqueous solution having dispersed therein a water soluble zinc copolymer complex of an acrylic acid and ethylacrylate copolymer. This copolymer contains between 50–90% by weight of acrylic acid and has a molecular weight within the range of 500–10,000. The ratio of copolymer to zinc is within the range of 1:1 to 6:1, with the pH of the aqueous solution of the zinc complex of the copolymer being with the range of 3–4.5. These compositions are used to treat aqueous recirculating systems by adding to the corrosive and/or scale forming water in such systems between 1–20 ppm of the zinc copolymer complex.

In a preferred mode, the amount of the zinc copolymer complex added to the corrosive waters is sufficient to provide between 0.5–2 ppm of zinc and between 1–4 ppm of the polymer.

As will be shown hereinafter, the invention's corrosion inhibiting effects are far greater than the effects achieved when the individual components, e.g. the copolymer and the zinc, are added separately to the system being inhibited.

THE ACRYLIC ACID ETHYLACRYLATE COPOLYMER

These copolymers are prepared by conventional solution polymerization techniques using water soluble free radical catalysts. See, for example, the polymerization technique in U.S. Pat. No. 4,196,272. The amount of acrylic acid to ethylacrylate in these polymers may vary between 50–90% by weight. Preferably the copolymers contain 80% by weight of acrylic acid.

Using known polymerization methods, the molecular weight of the copolymer should be maintained within the range of 500–10,000. A preferred copolymer of the invention would have a molecular weight of about 1500.

The copolymers, as indicated, are prepared using an aqueous solution polymerization technique. This polymerization should be done in the presence of a sufficient amount of water soluble base, e.g. alkali metals such as sodium or potassium to maintain the pH of the copolymer during its preparation as well as afterward at a pH within the range of 3–4.5. A preferred pH range is within the range of 3.5–4.

The copolymers are conveniently polymerized to provide polymer solution having a concentration of about 50%. This solution may be diluted to any desired concentration either prior to or after the zinc complex of the copolymer is formed. Preferably solutions of the invention contain from 2 up to 30% or more of the copolymer zinc complex.

THE FORMATION OF THE COPOLYMER ZINC COMPLEX

The zinc complex of the arcylic acid ethylacrylate copolymers with zinc is simply prepared. A soluble zinc salt such as zinc chloride is added to the preformed copolymer solution to provide a copolymer zinc metal weight ratio within the range of 1:1 to 6:1. A preferred ratio is 3:1.

As previously indicated, the aqueous solution of the copolymer from which the copolymer zinc complex is prepared should have an acid pH range within those previous specified. If the pH is not within these limits, an unstable complex is formed and a portion of the zinc precipitates from the solution.

MISCELLANEOUS

An optional, yet desirable, feature of the invention comprises utilizing the copolymer zinc complexes in combination with a scale or corrosion inhibiting amount of a water soluble phosphate compound. The phosphate may be utilized by incorporating phosphoric acid into the compositions of the inventions or the phosphate may be added to the system to be inhibited. The phosphate, when added to compositions, should be of such type and amount not to destabilize the complexes. When added to the system to be inhibited, the phosphate may be selected from inorganic phosphates such as the well-known sodium phosphates, the pyrophospates, or the molecular dehydrated polyphosphates, such as sodium hexemeta phosphate.

EXAMPLES

Preparation of the Zinc Copolymer Complex

EXAMPLE 1

This example illustrates the preparation of the zinc copolymer complexes.

The copolymer used in this example contained approximately 80% by weight of sodium acrylate expressed as acrylic acid and approximately 20% by weight of ethyl acrylate. It is in the form of a 20% aqueous solution. The polymer has a molecular weight of about 1500.

The composition was prepared by adding to the polymer solution the following ingredients in the amounts shown.

| Composition | % By Weight |
|---|---|
| Copolymer | 55.0 |
| Deionized water | 19.5 |
| Potassium Hydroxide, 45% active | 7.5 |
| Zinc Chloride 67% active | 18.0 |

The above ingredients, with the exception of the zinc chloride, were mixed together to form a homogeneous solution. To this was added the zinc chloride with good stirring. Following this mixing, the copolymer zinc complex of the invention was formed. The pH of the solution was about 3.7. This composition hereinafter is referred to as Composition A.

EXAMPLE 2

Using the same preparative techiques as shown in Example 1, Composition B was prepared from the following ingredients:

| Composition B | |
|---|---|
| Composition | % By Weight |
| Copolymer | 45.8 |
| Mobay OC-2003[1] | 4.0 |
| Deionized Water | 34.3 |
| Phosphoric Acid, 85% active | 9.7 |
| Zinc Chloride, 67% active | 6.2 |

[1]A Commercial water soluble Azole Copper Corrosion Inhibitor

In this example, the final product was heated to dissolve the Mobay OC-2003.

In both Examples 1 and 2, it is important to note that the zinc salt is added to the solution after all the other ingredients are present. Unless this is done, the complex produced tends to form insoluble zinc hydroxide.

The Valuation of the Composition of the Invention for Inhibiting Corrosion and Aqueous Recirculating systems

EXAMPLE 3

The test method employed was a laboratory size industrial cooling system. The details of this unit are described in the article entitled Small-Scale Short-Term Methods of Evaluating Cooling Water Treatments . . . Are They Worthwhile?, D. T. Reed and R. Nass, Nalco Chemical Company, International Water Conference, Pittsburgh, Pa., Nov. 4–6, 1975.

Using the above test equipment, Composition A was tested against its individual ingredients added separately to the test water. The water in the test units had the following composition:

| | |
|---|---|
| pH | 8.4–8.8 |
| alkalinity | 90–216 |
| calcium | 330–410 |
| magnesium | 80–275 |

Four tests were run using a treatment of 20 ppm Composition A and 2 ppm orthophosphate. Another four tests were run with the ingredients of Composition A separately added so that the final concentrations are equivalent to a 20 ppm Composition A plus 2 ppm orthophosphate. The components added separately are referred to as Composition C.

| Composition | Mild Steel Corrosion Rate In Mills Per Year |
|---|---|
| C | 20.00 |
| A | 4.26 |
| C | 26.17 |
| A | 3.52 |
| A | 2.85 |
| C | 2.96 |
| C | 21.69 |
| A | 3.04 |

Having thus described our invention, it is claimed as follows:

1. A composition for preventing corrosion and scale in aqueous recirculating systems which comprises an aqueous solution having dispersed therein a water soluble zinc copolymer complex of acrylic acid and ethylacrylate copolymer which copolymer contains between 50–90% by weight of an acrylic acid and has a molecular weight within the range of 500–10,000 with the ratio of copolymer to zinc being within the range of 1:1 to 6:1 and with the PH of the aqueous solution of the zinc complex of the copolymer being within the range of 3–4.5.

2. The composition of claim 1 where the copolymer contains about 80% by weight acrylic acid, the molecular weight of the copolymer is about 1500, the ratio of copolymer to zinc is about 3:1, and the PH of the zinc copolymer complex is within the range of 3.5–4.

3. A method of inhibiting the corrosion and of preventing scale in aqueous recirculating systems which comprises treating such water with at least 1 ppm of the zinc polymer complex of claim 1.

4. A method of inhibiting the corrosion and of preventing scale in aqueous recirculating systems which comprises treating such water with at least 1 ppm of the zinc polymer complex of claim 2.

* * * * *